US009715246B2

(12) United States Patent
Edwards et al.

(10) Patent No.: US 9,715,246 B2
(45) Date of Patent: Jul. 25, 2017

(54) STATE-BASED UNDERVOLTAGE HYSTERESIS

(71) Applicants: William E. Edwards, Dexter, MI (US); Anthony F. Andresen, Chandler, AZ (US)

(72) Inventors: William E. Edwards, Dexter, MI (US); Anthony F. Andresen, Chandler, AZ (US)

(73) Assignee: NXP USA, Inc., Austin, TX (US)

( * ) Notice: Subject to any disclaimer, the term of this patent is extended or adjusted under 35 U.S.C. 154(b) by 376 days.

(21) Appl. No.: 14/671,564

(22) Filed: Mar. 27, 2015

(65) Prior Publication Data

US 2016/0282896 A1 Sep. 29, 2016

(51) Int. Cl.
*G05F 5/00* (2006.01)
*H01H 9/54* (2006.01)

(52) U.S. Cl.
CPC ..... *G05F 5/00* (2013.01)

(58) Field of Classification Search
CPC ..... G05F 5/00; H01H 9/54
USPC ..... 307/140
See application file for complete search history.

(56) References Cited

U.S. PATENT DOCUMENTS 5,404,054 A 4/1995 Kotowski
8,198,920 B2 6/2012 Chatal

FOREIGN PATENT DOCUMENTS

EP 0905897 A2 3/1999
WO 2005006780 A2 1/2005

*Primary Examiner* — Robert Deberadinis

(57) ABSTRACT

A method of undervoltage detection includes detecting a voltage level for a power supply of a system, placing the system in an undervoltage state if the voltage level is below an undervoltage threshold, activating a load of the system at a first power level if the detected voltage level exceeds a first activation threshold and if the system resides in the undervoltage state, and activating the load at a second power level if the detected voltage level exceeds a second activation threshold.

20 Claims, 4 Drawing Sheets

STATE-BASED UNDERVOLTAGE HYSTERESIS

FIELD OF INVENTION

The present embodiments relate to undervoltage hysteresis.

BACKGROUND

Electronic and other electrical devices often act unpredictably or may be damaged if operated at low supply voltages. For example, an integrated circuit may be rated for operation at 4.5 Volts, but not at 4.2 Volts. A range of suitable power supply voltage levels may be specified. The integrated circuit may enter an indeterminate or other inappropriate state if the voltage level of the power supply falls below the range. Analog circuits may also exhibit improper behavior if operated at low voltages. Motors may be damaged if operated at less than the rated supply voltage.

A detection circuit is often used to monitor the supply voltage and disable functions if the voltage level of the power supply is less than a minimum required voltage or an undervoltage threshold (e.g., 4.2 Volts for power analog circuits driving motors). The detection circuit monitors the voltage level of the power supply and provides a signal indicative of whether the power supply is adequate. A control circuit then uses the signal to determine whether to disable or enable operation of the electrical devices. Disabling operation of an electrical device is referred to as undervoltage lockout.

The detection circuit may be configured to avoid unnecessary or excessive deactivation of system features. For example, the undervoltage determination often involves a temporal component. Filtering may be used. In this way, very narrow or brief changes (e.g., spikes) in the voltage level of the power supply are often filtered out.

Further attempts to avoid excessive cycling into and out of an undervoltage lockout may involve hysteresis. With hysteresis, the voltage level at which an increasing (rising) supply is deemed adequate may differ from the voltage level, or undervoltage threshold, at which a decreasing (falling) supply is deemed inadequate. The size, or spread, of the difference may be used to decrease how frequently system features are deactivated and reactivated in connection with undervoltage lockout.

The use of hysteresis may undesirably raise the minimum turn on voltage of a system. Different system components may have different minimum voltage supply levels. For example, control circuitry may be operational at voltage levels around 4.5 Volts, while such voltage levels may be insufficient to operate power driver circuits.

BRIEF DESCRIPTION OF THE DRAWINGS

The components and the figures are not necessarily to scale, emphasis instead being placed upon illustrating the principles of the various embodiments. Moreover, in the figures, like reference numerals designate corresponding parts throughout the different views.

DETAILED DESCRIPTION OF THE PRESENTLY PREFERRED EMBODIMENTS

Figure 1:
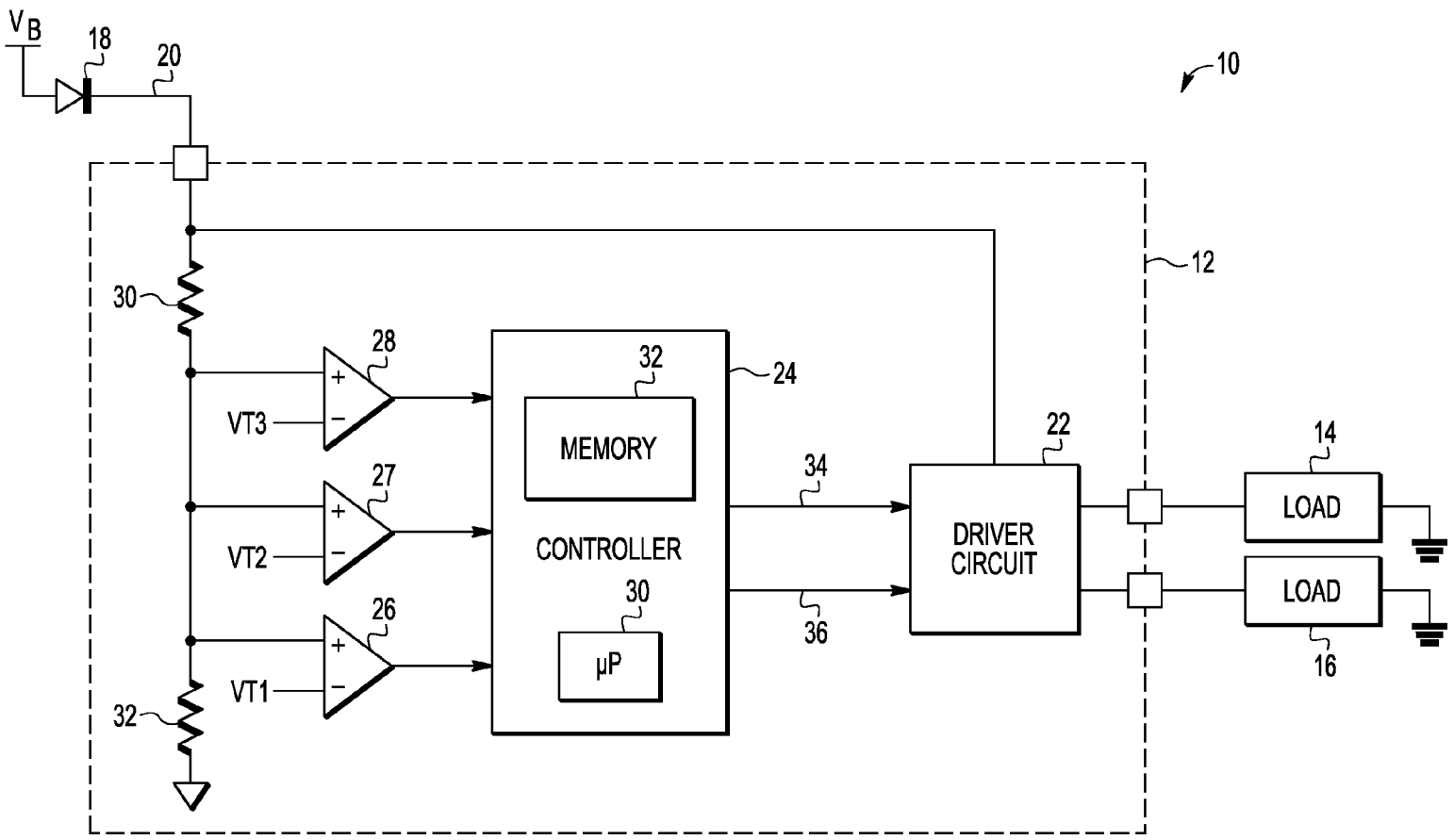
FIG. 1 is a block diagram of an exemplary circuit configured to control a driver circuit with state-based undervoltage hysteresis in accordance with one embodiment.

Embodiments of methods and circuits for undervoltage hysteresis are described. The undervoltage hysteresis may adapt or vary in accordance with a state of the system in which the hysteresis is implemented. A system may be placed in an undervoltage state upon detection of an undervoltage condition. Different activation thresholds may then be used to establish different hysteresis levels. For instance, the different activation thresholds may be used to determine at what voltage level or to what extent features are disabled or enabled. The voltage levels at which, and/or the extent to which, devices are activated or deactivated may also be varied in accordance with the system state. One or more of the activation thresholds may also be used to determine whether the system continues to reside in the undervoltage state.

Varying the hysteresis and power levels based on system state may be used to avoid oscillations during operation of an undervoltage detection circuit. Oscillation may occur as the detection circuit enters and exits the undervoltage condition. Entering and exiting the undervoltage condition may create large changes in the supply voltage sensed by the detection circuit as circuits or devices are disabled and enabled. That is, the current associated with the circuits or devices that are enabled or disabled modulates the supply voltage through the source impedance of that voltage (V=IR). For example, the voltage sensed by the detection circuit may swing 2 Volts (V) if an impedance of 1 Ohm is present (e.g., via a reverse blocking diode) between the power supply and a driver circuit for a DC motor that draws a current of 2 Amperes (A). The change in current through the impedance results in a 2 V step down from the supply voltage each time the DC motor is powered. If the 2 V drop falls below the undervoltage threshold, then the detection circuit cuts power to the driver circuit. But once the 2 A current ceases to flow through the 1 Ohm impedance, the voltage sensed by the detection circuit reverts back to a level 2 V higher. The undervoltage detection circuit may thus oscillate. The disclosed embodiments may be used to address such oscillation issues without resorting to a large (e.g., multiple Volt) hysteresis, which would undesirably raise the minimum operating voltage of the system.

The state-based hysteresis of the disclosed embodiments may allow a system to be operated at very low supply voltage levels. The disclosed embodiments may eliminate or reduce oscillation of the undervoltage detection circuits as loads are activated and deactivated despite operating at such low supply voltage levels. The disclosed embodiments may achieve low supply voltage operation without relying on a charge pump, thereby reducing conducted emissions.

The disclosed embodiments include undervoltage detection methods and systems with multiple thresholds to support different hysteresis for different system states. For example, a first activation threshold may be established for hysteresis when the system resides in an undervoltage state. Current may be provided at a first (e.g., lower) level when the first activation threshold is exceeded while the system resides in the undervoltage state. A second (e.g., higher)

activation threshold may be established for hysteresis to return the system to a normal, or non-undervoltage, operating state. Current may then be provided at a second (e.g., higher) level when the second activation threshold is exceeded, and the system resides in the normal operating state. Alternatively or additionally, for a falling supply, circuits or other loads may be selectively disabled or deactivated as the supply voltage passes one or more thresholds. Such selective deactivation is analogous to the selective activation of the load(s) in connection with a rising supply.

The undervoltage detection of the disclosed embodiments may be implemented with one or more comparators. For example, a comparator with hysteresis (a hysteresis comparator) may be used to determine a state of the power supply. The lower (or falling) threshold of the hysteresis comparator may be used to determine when a falling supply voltage causes the system to be placed in the undervoltage state. The upper (or rising) threshold of the hysteresis comparator may be used to determine when a rising supply causes the system to return to the normal operating state. Another comparator (e.g., a non-hysteresis comparator) may be provided to enable activation of a driver circuit at a third threshold other than the thresholds used to establish the power supply states. For example, the third threshold may be another activation threshold disposed between the rising and falling thresholds of the hysteresis comparator. Activation of the driver circuit at the third threshold may be at a power or current level less than the full rated current drive level of the driver circuit (e.g., the drive level for the normal operating state). Additional, fewer, or alternative comparators may be used. For example, a single comparator may be used to handle all of the thresholds. In other cases, three comparators are used, with each comparator establishing a respective threshold.

FIG. 1 depicts an electrical system 10 in which an undervoltage detection circuit 12 is provided to control the operation of loads 14, 16. The loads 14, 16 may be a motor, lamp, or any other type of internal or external load. The load 14, 16 may be configured for direct current (DC) or alternating current (AC) operation. In this embodiment, the loads 14, 16 are powered by a power supply $V_B$ via the circuit 12. The power supply $V_B$ is a battery in this case. Other types of voltage sources may be used. For example, the power source for the loads 14, 16 may be a high voltage AC power source, in which case the detection circuit 12 may also have a low voltage DC power source, which may or may not be derived from or otherwise related to the high voltage AC power source.

In some cases, the electrical system 10 is a vehicular electrical system. The power supply $V_B$ may be a 12 Volt vehicular battery. The voltage level may vary. In these and other cases, the loads 14, 16 are two of a number of loads controlled by the detection circuit 12. The nature and characteristics of the electrical system 10 may vary considerably. For example, detection circuit 12 may support the operation of any number of loads.

The detection circuit 12 may be integrated with one or more other control circuits. For example, the detection circuit 12 may include or be integrated with a control circuit responsive to one or more sensed switches, such as a push-button switch (e.g., a power window push-button switch) or other normally open sensed switch. The state of the sensed switch determines whether power is delivered to one or both of the loads 14, 16. The detection circuit 12 may also include or be integrated with wetting current circuitry to provide wetting current to the sensed switch. For example, the wetting current circuitry and/or other internal circuits may be one of the loads 14, 16.

In the example of FIG. 1, the system 10 includes a reverse blocking diode 18 between the power supply $V_B$ and the detection circuit 12. The forward voltage drop across the reverse blocking diode 18 versus the current running through the diode presents a source impedance. The reverse blocking diode 18 may be configured to block transient signals from reaching the power supply VB and other components of the system 10. The transient signals may be generated by, for instance, activation and deactivation of motors and other inductive components. The reverse blocking diode 18 may be disposed anywhere along a line 20 configured to carry current to the detection circuit 12 and the loads 14, 16. The location of the reverse blocking diode 18 may vary. For example, the reverse blocking diode 18 may be integrated with the detection circuit 12 in some cases.

The system 10 may have alternative or additional components disposed along the line 20 carrying current to the detection circuit 12 and the loads 14, 16. For example, the system 10 may include a wiring harness. These and other components, including wiring of the line 20 itself, present an impedance between the power supply $V_B$ and the detection circuit 12. A voltage drop is developed across the impedance when current flows through the line 20 to deliver power to one or both of the loads 14, 16. The detection circuit 12 is configured to avoid undervoltage oscillation that may otherwise arise as the loads 14, 16 are activated and deactivated.

The detection circuit 12 includes a driver circuit 22 and a controller 24. The driver circuit 22 is configured to provide power to one or more external or internal loads. The controller 24 is configured to direct the operation of the driver circuit 22. In this example, the driver circuit 22 provides power to both of the loads 14, 16. The driver circuit 22, or a portion thereof, may be disposed in the current path of the loads 14, 16. For example, the driver circuit 22 may include a respective power transistor, such as a discrete power field effect transistor (FET) device, or other switch serially disposed between the power supply VB and the respective load 14, 16. The current path may include one or more output pins or other output ports of the detection circuit 12.

The composition, configuration, and other characteristics of the driver circuit 22 may vary considerably. For instance, the driver circuit 22 may include any number of transistors or other switches to control the delivery of power to the loads 14, 16. The transistors may include low voltage or logic transistors as well as power transistors. Various types of power transistor devices may be used, including, for instance, bipolar junction transistor devices. Other types of switches may be used, including, for instance, relays. The detection circuit 12 may have any number of driver circuits.

The driver circuit 22 may not be included in the detection circuit 12 in some cases. For example, the controller 24 may direct the operation (e.g., activate) other types of loads directly, e.g., without an intermediate driver circuit. The loads activated or deactivated by the controller 24 may be internal (e.g., within the detection circuit 12) or external (e.g., outside of the detection circuit 12).

The detection circuit 10 also includes a plurality of comparators 26-28 coupled to the controller 24 and the power supply $V_B$. In this example, the non-inverting input terminals of the comparators 26-28 are coupled to the power supply $V_B$ via a resistor 30. The resistor 30 is part of a voltage divider, or resistor ladder, that includes a resistor 32 to lower the voltage level of the power supply $V_B$. Other resistive or coupling networks may be used to, e.g., allow low voltage comparators to be used. For instance, each comparator 26-28 may have a respective resistor to establish different voltage levels based on the voltage level of the power supply $V_B$. In other cases, a resistor ladder or other resistive arrangement is not present, and the power supply $V_B$ is directly measured.

The comparators 26-28 are configured to determine where the voltage level of the power supply $V_B$ falls relative to a plurality of thresholds. The thresholds are used to determine the state of the power supply $V_B$, as well as whether and to what extent power should be delivered to the driver circuit 22 and the loads 14, 16. In this example, the voltage level of the power supply $V_B$ is compared with three thresholds. The comparator 26 determines whether the voltage level of the power supply $V_B$ is below an undervoltage threshold VT1. The comparator 27 determines whether the voltage level of the power supply $V_B$ exceeds a first activation threshold VT2. The comparator 28 determines whether the voltage level of the power supply $V_B$ exceeds a second activation threshold VT3.

The activation threshold VT2 is lower than the activation threshold VT3. The activation threshold VT2 may correspond with a lower voltage level, but one at which the driver circuit 22 and one or more of the loads 14, 16 are operational. For example, the activation threshold VT2 may be at or near the bottom of a range of operating voltage levels for one or more of the driver circuit 22 and the loads 14, 16. In an automotive example of the system 10, the activation threshold VT2 may fall in a range from about 4 Volts to about 5 Volts. The activation threshold VT3, in contrast, may correspond with a voltage level in the normal operating range at which the current drop across the system impedance does not cause the sensed voltage for the power supply $V_B$ to fall below the undervoltage threshold VT1. Other thresholds may be used. For instance, the thresholds may vary considerably based upon several factors, including, for instance, the rated voltage level of the power supply $V_B$, the configuration of the driver circuit 22, and the loads 14, 16.

In the embodiment of FIG. 1, each comparator 26-28 is configured without hysteresis. In some cases, each comparator 26-28 is or includes an operational amplifier (op-amp). Other types of comparators may be used, including, for instance, various types of analog-to-digital converters. The composition, configuration, and other characteristics of each comparator 26-28 may thus vary. For instance, one or more of the comparators 26-28 may not be configured as op-amp comparators.

Various active circuitry may be used to establish or generate reference voltages for use as the thresholds VT1-VT3. For example, the detection circuit 12 may include one or more voltage regulators, such as zener diodes, to generate stable reference voltages. Passive circuitry may also be used. For example, one or more voltage dividers may be used in combination with the voltage regulator(s) to generate reference voltages for one or more of the respective thresholds VT1-VT3. In some cases, the circuitry used to generate the reference voltage(s) may be integrated with the circuitry used to provide the comparator function.

The number of thresholds may vary. For example, the detection circuit 12 may be configured to support more than two activation thresholds. As a result, the number of power supply states may also vary. For example, the detection circuit 12 may distinguish between multiple voltage ranges to establish any number of operational states in addition to the undervoltage state.

A respective output signal is generated by each comparator 26-28. Each output signal is indicative of whether the respective threshold has been exceeded or passed. Exceeding or passing a threshold may involve a rising voltage going higher than the threshold, as in the activation thresholds VT2, VT3. Exceeding or passing a threshold may also involve a falling voltage going lower than the threshold, as in the undervoltage threshold. In this example, the controller 24 is coupled to each comparator 26-28 to receive the output signals. Other circuit topologies may be used to provide the signals to the controller 24.

The thresholds are used to determine the state of the power supply $V_B$. The undervoltage threshold VT1 is used to determine when the power supply $V_B$ enters an undervoltage state (or condition). The system 10 enters the undervoltage state once the voltage level of the power supply $V_B$ falls below the undervoltage threshold VT1. In the example of FIG. 1, the system 10 exits the undervoltage state when the voltage level of the power supply $V_B$ rises above the activation threshold VT3. At that point, the power supply $V_B$ enters a normal operational state (e.g., a non-undervoltage state).

The controller 24 is configured to establish the power supply state in accordance with the output signals from the comparators 26-28. The controller 24 is then configured to control the driver circuit 22 in accordance with the power supply state. In the example of FIG. 1, the controller 24 is or includes a microprocessor 30 and a memory 32. Data indicative of the power supply state is stored in the memory 32. For example, a flag may be used to indicate an undervoltage state or a normal operating (e.g., non-undervoltage) state. Other data indicative of the comparator output signals may be stored in the memory 32.

The controller 24 may implement control logic (e.g., a control procedure) to direct the operation of the driver circuit 22. The control logic is based on the power supply state. The controller 24 is configured (e.g., via the control logic) to disable the driver circuit 22 if the voltage level of the power supply $V_B$ falls below the undervoltage threshold VT1. The driver circuit 22 may then be activated to provide power to one or both of the loads 14, 16 if the voltage level of the power supply $V_B$ rises above one of the activation thresholds VT2, VT3. The power level at which the driver circuit 22 is activated may depend on which activation threshold VT2, VT3 is exceeded, as well as the power supply state. For instance, power is provided at a lower power level if the voltage level exceeds the activation threshold VT2 and if the system still resides in the undervoltage state. The lower power level may be used to prevent the voltage sensed for the power supply $V_B$ from falling below the undervoltage threshold VT1 due to the voltage drop across the system impedance. Power is provided at a higher power level if the voltage level exceeds the activation threshold VT3, at which point the power supply state is changed from the undervoltage state to a non-undervoltage state. Further details and examples of the control logic are described and shown in connection with FIG. 4.

The controller 24 may generate one or more output signals to control the driver circuit 22. In the example of FIG. 1, the controller 24 generates and provides an enable signal on a line 34 and an amplitude control signal on a line 36. The enable signal may be used to activate and deactivate the driver circuit 22 and, thus, determine whether power is delivered to the loads 14, 16. The amplitude control signal may be used to determine the amplitude or level at which the driver circuit 22 (and/or the loads 14, 16) are powered. In this case, the level is either the lower power level or the higher power level. In some examples, the lower power level corresponds with a lower current level for the driver circuit 22 and/or the loads 14, 16. The lower power level may be alternatively establish through pulse width modulation (PWM). In such cases, the control signal on the line 36 may be indicative of a desired duty cycle or frequency for the PWM of the current to be provided to the loads 14, 16. A lower current or power level may be useful in connection with, for instance, a wetting current or other variable load. Alternatively or additionally, the lower power level corresponds with powering a subset of the loads 14, 16. In this case, only one of the two loads 14, 16 is powered during operation in the lower power level.

The configuration of the controller 24 may vary from the example shown. A variety of microcontrollers or other control units may be used. The processing and memory units or elements of the controller 24 may be configured and provided in various ways. For instance, the control logic may be hardwired into the controller 24 and/or provided via firmware or software. The memory 32 may be or include embedded memory. The memory 32 may include any combination of volatile and non-volatile memory. For example, the memory may be or include various types of random access memory (RAM), read-only memory (ROM), such as electrically erasable programmable ROM (EEPROM). The configuration and characteristics of the memory 32 may vary considerably. For instance, the memory 32 may be integrated with the microprocessor 30 or other processing unit to any desired extent.

The controller 24 may be integrated with other elements of the detection circuit 12 to a varying extent. For example, the controller 20 may be integrated with the other elements as a system on a chip "SoC" or as an application-specific integrated circuit (ASIC). In other cases, the controller 20 is disposed on a discrete chip, and integrated with the other elements of the detection circuit 12 on a circuit board. The controller 24 may thus be customized for undervoltage detection in various ways.

The controller 24 may include one or more modules or units dedicated to specific functions. For example, the controller 24 may include a digital-to-analog converter to generate one or more control signals, such as an amplitude control signal. Additionally or alternatively, the controller 24 includes a pulse width modulation (PWM) generator or module to generate a PWM control signal.

The controller 24 may be one of several controllers or control units in the system 10. Any number of loads 14, 16 may be controlled by each controller 24. Some of the components of the controller 24 may be replicated. For example, a respective instance of the controller component may be provided for each load 14, 16.

Figure 2:
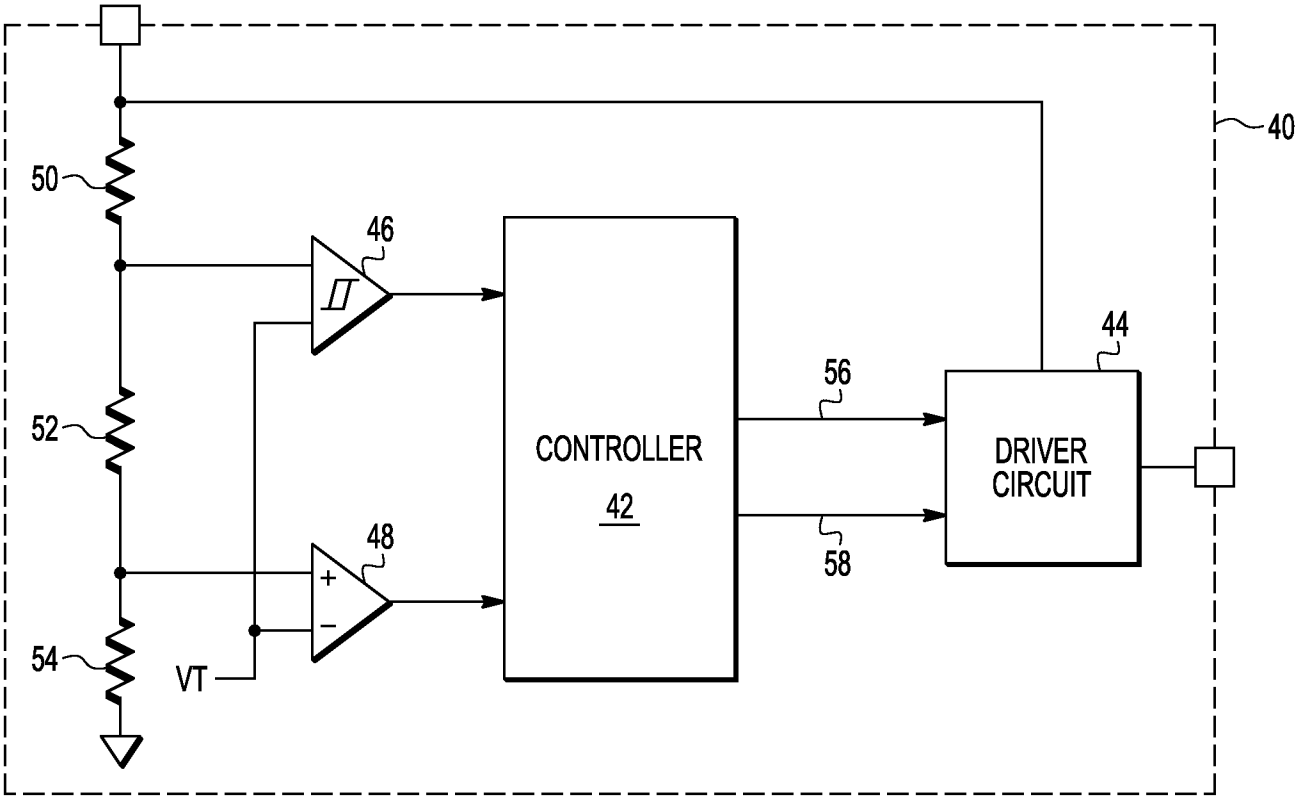
FIG. 2 is a block diagram of another exemplary circuit configured to control a driver circuit with state-based undervoltage hysteresis in accordance with one embodiment.

FIG. 2 depicts an exemplary detection circuit 40 configured in accordance with one embodiment. The detection circuit 40 may be similar in several ways to the detection circuit 12 described above in connection with FIG. 1. For instance, the detection circuit 40 includes a controller 42 and a driver circuit 44, each of which may be configured as described above. One way in which the embodiment of FIG. 2 differs from the examples described above involves the plurality of comparators used to determine the power supply state. In this example, the detection circuit 40 includes a hysteresis comparator 46 and a non-hysteresis comparator 48. The comparators 46, 48 may be or include op-amp comparators, analog-to-digital converters, and/or other components.

In the example of FIG. 2, the hysteresis comparator 46 is used to determine the power supply state. The hysteresis comparator 46 has a falling threshold that establishes the undervoltage threshold. The rising threshold of the hysteresis comparator 46 establishes the voltage level at which the power supply state exits the undervoltage state. The rising threshold of the hysteresis comparator 46 may thus be the higher of the two activation thresholds, e.g., the threshold at which the driver circuit 44 is directed to provide full rated power. The controller 42 may accordingly store data indicative of a normal operating state if the voltage level rises above the rising threshold. The threshold provided by the other comparator 48 may then be the lower activation threshold at which the driver circuit 22 is directed to provide a lower or limited amount of power. In an alternative embodiment, the activation thresholds are reversed. In that case, the rising threshold of the hysteresis comparator 46 is used to establish the lower activation threshold and the threshold of the other comparator 48 is used to establish the higher activation threshold.

The thresholds of the comparators 46, 48 may be compared to different voltages representative of the power supply voltage. In the example of FIG. 2, resistors 50, 52, and 54 are disposed in a voltage divider arrangement. The voltage divider arrangement may be configured such that a single reference voltage VT may be used for both of the comparators 46, 48. The reference voltage VT may be generated via a voltage regulator or other circuit as described above in connection with FIG. 1.

The controller 42 may generate one or more control signals for the driver circuit 44, as described above in connection with FIG. 1. In this example, an enable signal is generated on a line 56 and a PWM signal is generated on a line 58. The nature of the control signals may vary.

Figure 3:
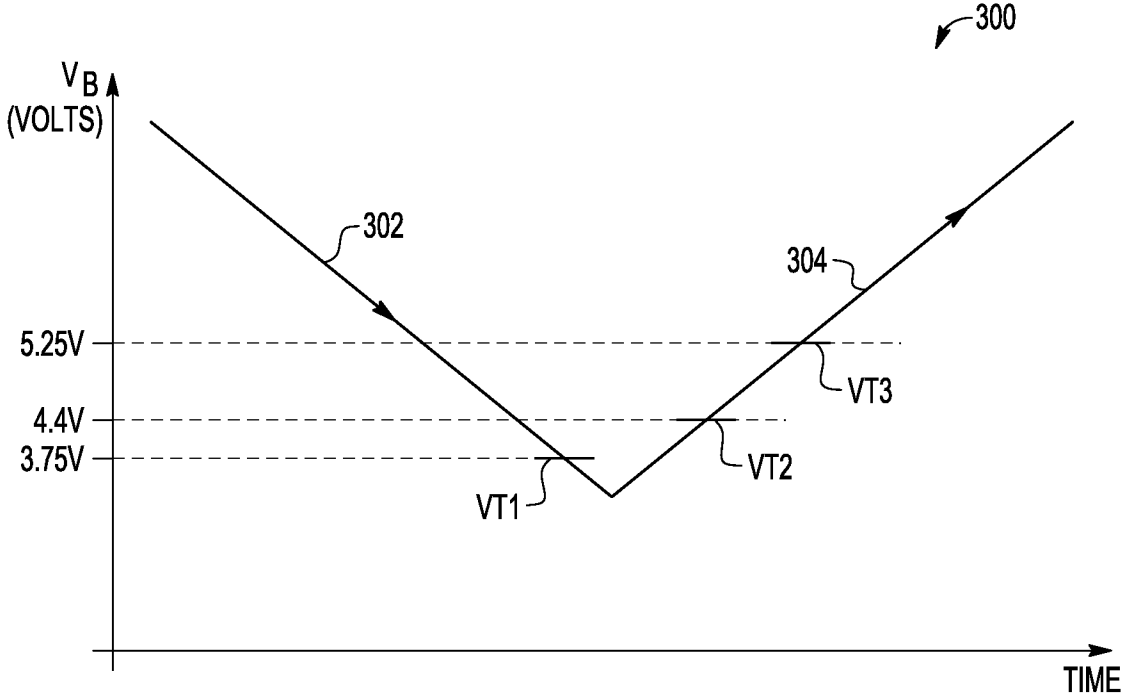
FIG. 3 is a graphical plot of the state-based undervoltage hysteresis implemented in accordance with one embodiment.

FIG. 3 is a graphical plot 300 to depict an exemplary set of thresholds for the plurality of comparators. In this example, three thresholds VT1-VT3 are used for undervoltage correction and activation control. The threshold VT1 is the falling or undervoltage threshold. In this example, the undervoltage threshold VT1 is at about 3.75 Volts. The undervoltage threshold VT1 is used when the battery voltage level $V_B$ resides in a normal operating state and is falling, an example of which is indicated by an arrow 302. Once the battery voltage level $V_B$ passes the undervoltage threshold VT1, the state changes to the undervoltage state and one or more features are disabled (deactivated).

The activation thresholds VT2 and VT3 are used when the battery voltage VB is rising, an example of which is indicated by an arrow 304. The threshold VT2 is a lower activation threshold. In this example, the lower activation threshold VT2 is at about 4.4 Volts. Once the battery voltage $V_B$ exceeds the activation threshold VT2, power is provided at a first (or lower) level.

The system remains in the undervoltage state until the activation threshold VT3 is exceeded. In this example, the second or higher activation threshold VT3 is at about 5.25 Volts. Once the battery voltage $V_B$ exceeds the activation threshold VT3, power is provided at a second (or higher) level. The second level may be a full rated level.

Additional or alternative activation thresholds may be used. For example, three or more activation thresholds may be used. The three or more activation thresholds may correspond with three or more levels at which power is provided. The multiple power levels may be useful for gradually increasing the power without causing the sensed battery voltage $V_B$ to drop below the undervoltage threshold VT1.

Figure 4:
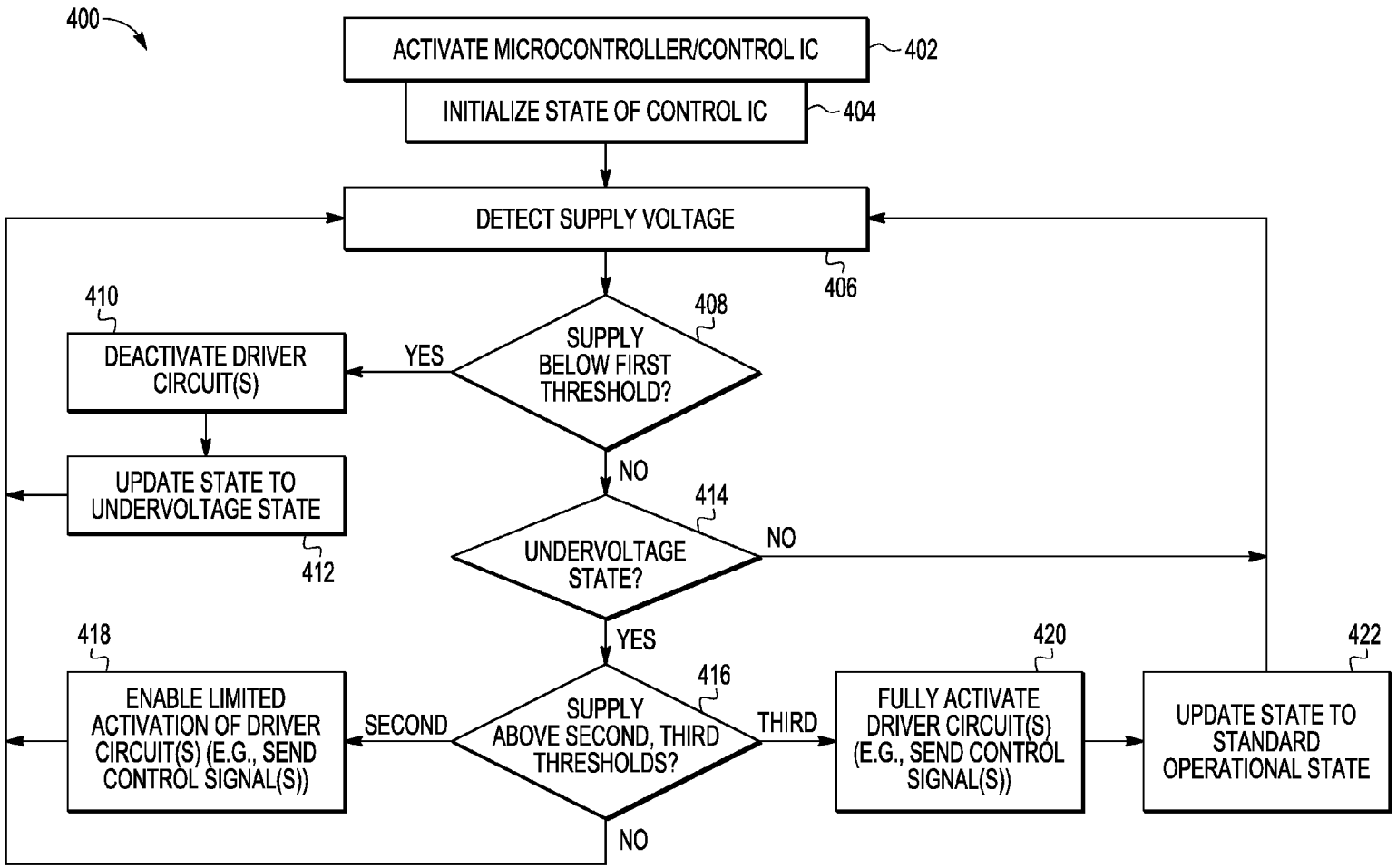
FIG. 4 is a process flow diagram of an exemplary method of state-based undervoltage hysteresis in accordance with one embodiment.

FIG. 4 shows an exemplary method 400 for state-based undervoltage detection and control. The method may be implemented by the control circuits or controllers described above. In some cases, another processor or controller may be used to implement the method either in conjunction with the above-described controllers or separately therefrom. The method 400 includes a sequence of acts or steps, only the salient of which are depicted for convenience in illustration. Additional, fewer, or alternative acts may be included. For example, the method 400 may include a number of acts involving additional states and/or power levels. The ordering of the acts may vary in other embodiments. For example, updates to the voltage supply states may occur before the activation or deactivation of the driver circuit(s).

The method 400 may begin with, or include, the activation in an act 402 of a controller, such as a microcontroller or other control IC. The act 402 may be implemented in connection with a startup sequence and/or in connection with a reset procedure. In the example of FIG. 4, the act 402 includes the initialization in an act 404 of the state of the controller. The state of the controller may include a state or be otherwise indicative of the state of the power supply. In some cases, the initial power supply state may be a standard or normal operational state. The exemplary method 400 of FIG. 4 may thus address circumstances in which the supply voltage is falling. Rising supply circumstances may also be addressed accordingly.

The supply voltage is detected or sensed in an act 406. The detection may occur in various ways and include various components. For example, comparators and/or analog-to-digital converters may be used. The act 406 may be periodically implemented. For instance, the supply voltage may be sampled or otherwise detected at a desired rate.

A decision block 408 determines whether a voltage level of the power supply is below a first threshold, such as the undervoltage thresholds described above. If so, the system is placed in an undervoltage state. In the example of FIG. 4, control passes to an act 410 in which one or more driver circuits (or other load(s)) are deactivated. Current is accordingly no longer provided to one or more loads.

A state of the system is updated in an act 412 to reflect the undervoltage condition. The act 412 may include storing data indicative of the undervoltage state in a memory. For example, a flag may be updated.

As shown in FIG. 4, control may then return to the act 406 for another iteration of the undervoltage control procedure. The voltage level of the power supply may be detected at that point or at the next scheduled time for sampling and/or implementation of the undervoltage control procedure.

Control passes to another decision block 414 once, during a subsequent iteration, the voltage level is no longer below the undervoltage threshold. The decision block 414 determines whether the state resides in the undervoltage state. If not, then the system state does not change and the driver circuit(s) and/or load(s) remain disabled. Control may return to the act 406 for further supply voltage detection.

If the state resides in the undervoltage state, then control passes to yet another decision block 416 for control logic involving a number of activation thresholds higher than the undervoltage threshold, as described above. In this example, there are two activation thresholds with which a rising supply voltage is compared. If the voltage level fails to exceed either one, then control may return to the act 406 for another iteration. The system remains in the undervoltage state and the driver circuit(s) and/or load(s) remain disabled.

Control passes to an act 418 if the voltage level exceeds a lower activation threshold of the activation thresholds. The load(s) are then activated in the act 418 at a first power level. For example, a driver circuit is directed in the act 418 to provide power at a first (lower) power level. Control passes to an act 420 if the voltage level exceeds a higher activation threshold of the activation thresholds. The load(s) are then activated in the act 420 at a second (higher) power level. For example, the driver circuit is directed in the act 420 to provide power at the second (higher) power level. As described above, the first power level is lower than the second power level. For example, the second power level may be at or near a full rated drive level for the driver circuit. The first power level may be offset from the full rated drive level by an amount such that activating the driver circuit at the first power level does not drop the detected voltage level below the undervoltage threshold.

The act 418 may include sending a number of control signals to a driver circuit. Two control signals are provided in some cases. A first control signal is sent and configured to activate the driver circuit. The first control signal may thus be a binary signal. A second control signal is sent and configured to establish a level at which the driver circuit provides the power. For example, an amplitude control signal may be sent to the driver circuit. Alternatively or additionally, the control signal may be configured to direct the driver circuit to provide power to a subset of a plurality of loads. Alternatively or additionally, a pulse width modulation control signal may be sent to the driver circuit. Any combination of these and other control signals may be used to modulate the power level and thereby avoid oscillation in the undervoltage detection system.

In the example of FIG. 4, the system remains in the undervoltage state despite the power supply voltage level rises above the first (lower) activation threshold. Control may return to the act 406 for another sampling of the voltage level.

The act 420 may also include sending a number of control signals to a driver circuit. The control signals may correspond with those described above in connection with the act 418. For example, the first control signal may again be used to activate (e.g., enable the operation of) the driver circuit. The value, data, or other characteristic(s) of the second control signal may be adjusted to direct the driver circuit to provide power at the second power level.

In an act 422, the system is removed from the undervoltage state. In the example of FIG. 4, the state is updated to a normal or standard operational state. Updating the state may include storing data indicative of the normal operational state in a memory, as described above. In other cases, one or more additional states may be disposed between the undervoltage state and the normal operating state. In either case, control may then return to the 406 for another iteration of the procedure.

Described above are multi-threshold supply detection systems that control at what voltage which circuits are enabled/disabled, and how. The above-described methods and systems address undervoltage detection of a power supply in which circuits and/or other loads are disabled at low supply voltage levels to ensure reliable and predictable system operation and/or to avoid damage to components. The loads may be internal or external. As described above, enabling and disabling the load(s) changes the supply current, which, in turn, modulates the measured level of the supply voltage due to the source impedance of the supply (e.g., resistance in a wiring harness, connectors, and/or a reverse blocking diode). Modulation of the supply voltage measurement may cause the undervoltage detection to oscillate.

The state-based control techniques and/or partial activation of the load(s) of the above-described methods and systems are configured to avoid such modulation. The state-based control and/or partial load activation may allow functionality to be provided at the lowest possible supply voltage level without oscillating into and out of the undervoltage condition. The partial load activation may be or involve pulse width modulation and/or other techniques, such as linear or continuous reduction in the load current or supplied voltage.

In a first aspect, a method of undervoltage detection includes detecting a voltage level for a power supply of a system, placing the system in an undervoltage state if the detected voltage level is below an undervoltage threshold, activating the load at a first power level if the detected voltage level exceeds a first activation threshold and if the system resides in the undervoltage state, and activating the load at a second power level if the detected voltage level exceeds a second activation threshold.

In a second aspect, a method of undervoltage detection includes detecting a voltage level for a power supply of a system, disabling a load and placing the system in an undervoltage state if the voltage level is below an undervoltage threshold, activating the load at a first power level if the detected voltage level exceeds a first activation threshold and if the system resides in the undervoltage state, and activating the load at a second power level if the detected voltage level exceeds a second activation threshold. The first power level is lower than the second power level. The undervoltage threshold is lower than the first and second activation thresholds. The first activation threshold is lower than the second activation threshold.

In a third aspect, a system for undervoltage detection includes a driver circuit to provide power to a load, a controller configured to direct operation of the driver circuit, the controller including a memory in which data indicative of a power supply state is stored. The system further includes a plurality of comparators coupled to the controller and a power supply for the driver circuit, the plurality of comparators being configured to detect whether a voltage level of the power supply is below an undervoltage threshold, whether the voltage level exceeds a first activation threshold, and whether the voltage level exceeds a second activation threshold. The controller is further configured to disable the driver circuit and store data in the memory indicative of an undervoltage state if the voltage level falls below the undervoltage threshold. The controller is further configured to activate the driver circuit to provide power at a first power level if the voltage level exceeds the first activation threshold and if the system resides in the undervoltage state. The controller is further configured to direct the driver circuit to provide power at a second power level if the detected voltage level exceeds the second activation threshold.

Although described in connection with electrical devices in vehicles, the disclosed embodiments are not limited to any particular type of load or device context. A wide variety of loads may be driven via the systems described herein. The state-based undervoltage detection of the disclosed embodiments is thus not limited to motors (or DC motors), lamps, or other types of loads commonly present on vehicles.

The disclosed embodiments are also compatible with a variety of different power supplies. The disclosed embodiments are not limited to uses involving automotive batteries or 12-Volt batteries. A wide variety of batteries and other DC power supplies may be sensed via the disclosed embodiments.

Embodiments of the present invention are defined by the following claims and their equivalents, and nothing in this section should be taken as a limitation on those claims. Further aspects and advantages of the invention are discussed above in conjunction with the disclosed embodiments and may be later claimed independently or in combination.

While the invention has been described above by reference to various embodiments, it should be understood that many changes and modifications may be made without departing from the scope of the invention. It is therefore intended that the foregoing detailed description be regarded as illustrative rather than limiting, and that it be understood that it is the following claims, including all equivalents, that are intended to define the spirit and scope of this invention.

The invention claimed is:

1. A method of undervoltage detection, the method comprising:

detecting a voltage level for a power supply of a system, the system comprising a load;

placing the system in an undervoltage state if the detected voltage level is below an undervoltage threshold;

activating the load at a first power level if the detected voltage level exceeds a first activation threshold and if the system resides in the undervoltage state; and activating the load at a second power level if the detected voltage level exceeds a second activation threshold.

2. The method of claim 1, wherein the first power level is lower than the second power level.

3. The method of claim 1, wherein the second power level is at a full rated drive level for the load.

4. The method of claim 1, wherein:

the undervoltage threshold is lower than the first and second activation thresholds; and the first activation threshold is lower than the second activation threshold.

5. The method of claim 1, wherein activating the load at the first power level comprises:

sending a first control signal to a driver circuit of the system, the first control signal being configured to activate the driver circuit;

sending a second control signal to the driver circuit, the second control signal being configured to establish a level at which the driver circuit provides the power.

6. The method of claim 1, wherein activating the load at the first power level comprises sending an amplitude control signal to a driver circuit of the system.

7. The method of claim 1, wherein:

the load is one of a plurality of loads of the system; and activating the load at the first power level comprises sending a control signal to a driver circuit of the system, the control signal being configured to direct the driver circuit to provide power to a subset of the plurality of loads.

8. The method of claim 1, wherein activating the load at the first power level comprises sending a pulse width modulation control signal to a driver circuit of the system.

9. The method of claim 1, wherein the first power level is offset from the second power level by an amount such that activating the load at the first power level does not drop the detected voltage level below the undervoltage threshold.

10. The method of claim 1, wherein activating the load at the second power level comprises removing the system from the undervoltage state.

11. A method of undervoltage detection, the method comprising:

detecting a voltage level for a power supply of a system;

if the voltage level is below an undervoltage threshold, disabling a load and placing the system in an undervoltage state;

activating the load at a first power level if the detected voltage level exceeds a first activation threshold and if the system resides in the undervoltage state; and activating the load at a second power level if the detected voltage level exceeds a second activation threshold;

wherein:

the first power level is lower than the second power level;

the undervoltage threshold is lower than the first and second activation thresholds; and the first activation threshold is lower than the second activation threshold.

12. The method of claim 11, wherein activating the load at the first power level comprises:

sending a first control signal to a driver circuit of the system, the first control signal being configured to activate the driver circuit;

sending a second control signal to the driver circuit, the second control signal being configured to establish a level at which the driver circuit provides the power.

13. The method of claim 11, wherein activating the load at the first power level comprises sending an amplitude control signal to a driver circuit of the system.

14. The method of claim 11, wherein:

the load is one of a plurality of loads of the system; and activating the load at the first power level comprises sending a control signal to a driver circuit of the system, the control signal being configured to direct the driver circuit to provide power to a subset of the plurality of loads.

15. The method of claim 11, wherein activating the load at the first power level comprises sending a pulse width modulation control signal to a driver circuit of the system.

16. The method of claim 11, wherein the first power level is offset from the second power level by an amount such that activating the load at the first power level does not drop the detected voltage level below the undervoltage threshold.

17. A system for undervoltage detection, the system comprising:

a driver circuit to provide power to a load;

a controller configured to direct operation of the driver circuit, the controller comprising a memory in which data indicative of a power supply state is stored;

a plurality of comparators coupled to the controller and a power supply for the driver circuit, the plurality of comparators being configured to detect whether a voltage level of the power supply is below an undervoltage threshold, whether the voltage level exceeds a first activation threshold, and whether the voltage level exceeds a second activation threshold;

wherein:

the controller is further configured to disable the driver circuit and store data in the memory indicative of an undervoltage state if the voltage level falls below the undervoltage threshold;

the controller is further configured to activate the driver circuit to provide power at a first power level if the voltage level exceeds the first activation threshold and if the system resides in the undervoltage state; and the controller is further configured to direct the driver circuit to provide power at a second power level if the detected voltage level exceeds the second activation threshold.

18. The system of claim 17, wherein the plurality of comparators comprises first, second, and third comparators configured to establish the undervoltage threshold, the first activation threshold, and the second activation threshold, respectively.

19. The system of claim 17, wherein the plurality of comparators comprises a hysteresis comparator having a falling threshold that establishes the undervoltage threshold and a rising threshold that establishes the first activation threshold or the second activation threshold.

20. The system of claim 17, wherein the controller is further configured to store data in the memory indicative of a normal operating state if the voltage level rises above the rising threshold.

* * * * *